US005977759A

United States Patent [19]

Sitch

[11] Patent Number: 5,977,759

[45] Date of Patent: Nov. 2, 1999

[54] CURRENT MIRROR CIRCUITS FOR VARIABLE SUPPLY VOLTAGES

[75] Inventor: John Edward Sitch, Ottawa, Canada

[73] Assignee: Nortel Networks Corporation, Montreal, Canada

[21] Appl. No.: 09/257,053

[22] Filed: Feb. 25, 1999

[51] Int. Cl.[6] ..... G05F 1/56

[52] U.S. Cl. ..... 323/315

[58] Field of Search ..... 323/313, 314, 323/315; 327/535, 538, 539; 330/257, 288

[56] References Cited

U.S. PATENT DOCUMENTS

| | | | |
|---|---|---|---|
| 3,875,430 | 4/1975 | Prak | 307/297 |
| 4,019,121 | 4/1977 | Feindt | 323/315 |
| 4,325,017 | 4/1982 | Schade, Jr. | 323/313 |
| 4,330,744 | 5/1982 | Embree et al. | 323/316 |
| 4,399,399 | 8/1983 | Joseph | 323/315 |
| 4,591,780 | 5/1986 | Yamada et al. | 323/313 |
| 5,038,053 | 8/1991 | Djenguerian et al. | 307/310 |
| 5,173,656 | 12/1992 | Seevinck et al. | 323/314 |
| 5,446,397 | 8/1995 | Yotsuyanagi | 327/66 |
| 5,498,952 | 3/1996 | Ryat | 323/312 |
| 5,539,302 | 7/1996 | Takimoto et al. | 323/315 |
| 5,570,008 | 10/1996 | Goetz | 323/315 |
| 5,670,868 | 9/1997 | Moriguchi et al. | 323/313 |
| 5,793,194 | 8/1998 | Lewis | 323/312 |
| 5,838,149 | 11/1998 | Perraud | 323/315 |
| 5,847,556 | 12/1998 | Kothandaraman et al. | 323/315 |
| 5,864,228 | 1/1999 | Brown et al. | 323/315 |
| 5,889,665 | 3/1999 | Han | 363/60 |

*Primary Examiner*—Matthew Nguyen
*Attorney, Agent, or Firm*—R. John Haley

[57] ABSTRACT

A current mirror circuit comprises first and second resistors for conducting first and second reference currents dependent upon a supply voltage, and first and second current mirrors coupled to the first and second resistors, the second resistor being in series with a voltage reference. The second current mirror mirrors the second reference current, and its mirrored current output is subtracted from the first reference current, the difference current being mirrored by the first current mirror to produce a controlled output current. The circuit can be arranged so that the controlled output current is independent of changes of the supply voltage, or, optionally with further current mirrors and voltage references, so that the controlled output current has a desired relationship with the supply voltage. A circuit is described for a cellular telephone transmitter power amplifier for which the controlled current decreases with increasing supply voltage in a working range, and decreases more rapidly beyond this range for overvoltage protection.

18 Claims, 2 Drawing Sheets

CURRENT MIRROR CIRCUITS FOR VARIABLE SUPPLY VOLTAGES

This invention relates to current mirror circuits, and is particularly concerned with current mirror circuits for use with variable supply voltages.

BACKGROUND OF THE INVENTION

Current mirror circuits are well known and widely used in various applications, especially for providing controlled currents in integrated circuits. A current mirror circuit makes use of a reference current source to determine a mirrored current. In the absence of an accurate reference current source, it is common to derive the reference current via a resistor coupled to a power supply voltage. When the supply voltage is sufficiently well regulated, this can provide a sufficiently accurate reference current, but in other situations, for example when it is desired to avoid costs and loss of efficiency associated with supply voltage regulation, it becomes desirable to compensate for supply voltage variations in the generation of the reference current for the current mirror circuit.

In addition, there can be circumstances in which it is desirable to control currents generated by current mirror circuits in a particular predetermined manner with variations in supply voltage. For example, for optimum operation of a transmitter power amplifier of a portable cellular radio telephone with varying battery supply voltage, it may be desirable to increase a bias current as the supply voltage falls in order to extend a low-voltage working range of the telephone, and/or it may be desirable to limit this bias current in the event that the supply voltage exceeds a normal working range, thereby providing an over-voltage shutdown function.

By way of example, Prak U.S. Pat. No. 3,875,430 issued Apr. 1, 1975 and entitled "Current Source Biasing Circuit" discloses a current source in which a square law dependency of output current on supply voltage is overcome by operating a field effect transistor in an exponential portion of its current-voltage characteristic, making the output current substantially independent of the supply voltage. Joseph U.S. Pat. No. 4,399,399 issued Aug. 16, 1983 and entitled "Precision Current Source" discloses a current source using a two-transistor current drive network in which a ratio of current densities is controlled to a predetermined value using an amplifier feedback circuit, an output current being produced dependent upon the ratio of the current densities and independent of supply voltage variations. Yamada et al. U.S. Pat. No. 4,591,780 issued May 27, 1986 and entitled "Constant Current Source Device Having A Ratio Metricity Between Supply Voltage And Output Current" discloses a current source in which an output current changes at substantially the same rate as changes in the supply voltage.

Other current source circuits are known which provide compensation for process and/or temperature variations, and/or which use two or more current mirror circuit stages. Examples of these are found in Djenguerian et al. U.S. Pat. No. 5,038,053 issued Aug. 6, 1991 and entitled "Temperature-Compensated Integrated Circuit For Uniform Current Generation"; Ryat U.S. Pat. No. 5,498,952 issued Mar. 12, 1996 and entitled "Precise Current Generator"; Perraud U.S. Pat. No. 5,838,149 issued November 17, 1998 and entitled "Voltage Control Means Having A Reduced Sensitivity To Temperature Variations"; Kothandaraman et al. U.S. Pat. No. 5,847,556 issued Dec. 8, 1998 and entitled "Precision Current Source"; and Brown et al. U.S. Pat. No. 5,864,228 issued Jan. 26, 1999 and entitled "Current Mirror Current Source With Current Shunting Circuit".

An object of this invention is to provide an improved current mirror circuit.

SUMMARY OF THE INVENTION

One aspect of this invention provides a current mirror circuit comprising: a first current mirror comprising a first transistor having a control electrode and a controlled path, a first resistor coupled between the controlled path of the first transistor and a supply voltage for determining a first reference current, and a second transistor having a control electrode coupled to the control electrode of the first transistor and having a controlled path for conducting an output current which mirrors current conducted via the controlled path of the first transistor; and a second current mirror comprising a third transistor having a control electrode and a controlled path, a second resistor and a voltage reference coupled in series between the controlled path of the third transistor and the supply voltage for determining a second reference current, and a fourth transistor having a control electrode coupled to the control electrode of the third transistor and having a controlled path for conducting a current which mirrors current conducted via the controlled path of the third transistor; wherein the controlled paths of the first and fourth transistors are coupled together so that the controlled path of the first transistor conducts the first reference current reduced by the current conducted via the controlled path of the fourth transistor.

The current mirrors can be arranged so that the output current is substantially independent of the supply voltage, or so that the output current changes, e.g. decreases, with increasing magnitude of the supply voltage greater than a reference voltage provided by the voltage reference.

The current mirror circuit can further comprise a third current mirror comprising a fifth transistor having a control electrode and a controlled path, a third resistor and a second voltage reference coupled in series between the controlled path of the fifth transistor and the supply voltage for determining a third reference current, and a sixth transistor having a control electrode coupled to the control electrode of the fifth transistor and having a controlled path for conducting a current which mirrors current conducted via the controlled path of the fifth transistor, the controlled path of the sixth transistor being coupled to the controlled path of the first transistor so that current conducted via the controlled path of the first transistor is further reduced by the current conducted via the controlled path of the sixth transistor. In this and similar ways various relatively arbitrary relationships can be established between the output current and the supply voltage, as may be desired.

Another aspect of the invention provides a method of producing a controlled current, comprising the steps of: producing a first reference current dependent upon a supply voltage; producing a second reference current dependent upon a difference between the supply voltage and a first reference voltage; mirroring the second reference current to produce a mirrored current; producing a difference current dependent upon a difference between the first reference current and the mirrored current; and mirroring the difference current to produce the controlled current.

The first and second reference currents can be produced with similar dependence upon the supply voltage so that the difference current is substantially independent of the supply voltage for values of the supply voltage greater than the first reference voltage, or they can be produced so that the difference current changes, e.g. decreases, with increasing values of the supply voltage greater than the first reference voltage.

The method can further comprise the steps of: producing a third reference current dependent upon a difference between the supply voltage and a second reference voltage, the second reference voltage being greater than the first reference voltage; mirroring the third reference current to produce a second mirrored current; and reducing the difference current by the second mirrored current.

A further aspect of this invention provides a current mirror circuit comprising: a first resistor for conducting a first reference current dependent upon a supply voltage; a first current mirror coupled to the first resistor; a second resistor for conducting a second reference current dependent upon the supply voltage and a reference voltage; and a second current mirror coupled to the second resistor and being arranged to mirror the second reference current to produce a mirrored current at an output of the second current mirror, said output being coupled to the first current mirror; the first current mirror being arranged to mirror a difference current between the first reference current and said mirrored current to produce a controlled current.

Each of the current mirrors can conveniently comprise two bipolar transistors, each transistor having a collector-emitter path coupled in series with an emitter resistor. The first resistor can be coupled to a line for the supply voltage, and the second resistor can be coupled in series with at least one diode-connected bipolar transistor, providing said reference voltage, to the line for the supply voltage. The provision of the reference voltage in this manner is particularly convenient in a bipolar transistor integrated circuit, but it can be appreciated that any other desired form of voltage reference can alternatively be used.

BRIEF DESCRIPTION OF THE DRAWINGS

The invention will be further understood from the following description with reference to the accompanying drawings, in which.

DETAILED DESCRIPTION

Figure 1:
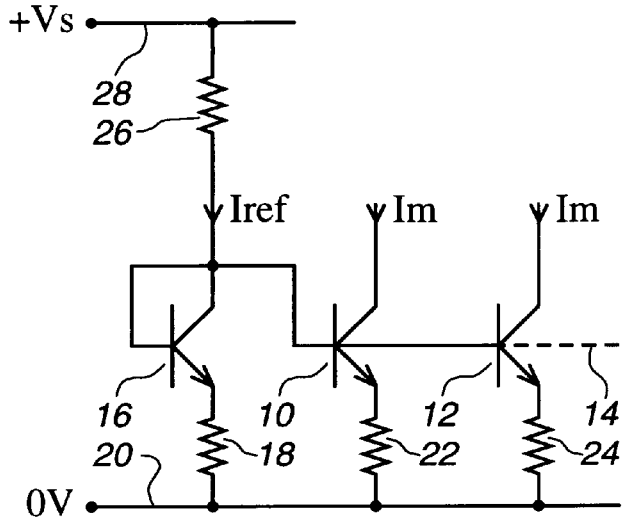
Fig. 1 PRIOR ART
FIG. 1 illustrates a circuit diagram of a known current mirror circuit.

Referring to the drawings, FIG. 1 illustrates a circuit diagram of a known current mirror circuit, which as illustrated mirrors a reference current Iref using two bipolar NPN transistors 10 and 12 each conducting via its collector a mirrored current Im from a suitable supply voltage and via a respective load which are not shown. As indicated by a dashed line 14, further current mirror transistors can be provided in a similar manner.

The reference current Iref is applied to the inter-connected base and collector of a bipolar NPN transistor 16 whose emitter is coupled via an optional resistor 18 to a point of reference potential, in this case a zero voltage line 20. The collector and base of the transistor 16 are also connected to the bases of the transistors 10 and 12, whose emitters are similarly connected to the zero voltage line 20 via optional resistors 22 and 24 respectively. The optional emitter resistors 18, 22, and 24 improve current sharing in the case of variability among the transistors, and contribute to thermal stability.

The reference current Iref is typically desired to be provided by a constant current source so that it is a constant current. For simplicity in the current mirror circuit of FIG. 1, this reference current Iref is provided by current flow through a resistor 26 connected between the collector of the transistor 16 (and hence also the bases of the transistors 10, 12, and 16) and a line 28 coupled to a positive supply voltage +Vs. This supply voltage can, but need not, be the same as the supply voltage from which the mirrored currents Im are derived.

For simplicity and convenience, it is assumed here that each mirrored current Im is equal to the reference current Iref, but it can be appreciated that the relative sizes of the transistors and the resistor values can be scaled as is known in the art to provide scaling of the mirrored currents relative to the reference current Iref. In addition, it can be appreciated that although this description refers to NPN bipolar transistors, other polarity bipolar transistors and other types of transistor, such as field effect transistors, can alternatively be used.

It can be seen from the circuit of FIG. 1 that:

$$Iref=(Vs-Vbe)/R$$

where Vbe is the base-emitter voltage of the transistor 16 for the current Iref, and R is the total resistance of the resistors 18 and 26. From this equation it can be seen that the reference current Iref depends linearly on (Vs−Vbe), with a fractional sensitivity to the supply voltage Vs which is greater than 1. In other words, a change of for example 1% in the supply voltage Vs results in a change of more than 1% in the reference current Iref. Thus a stability of the reference current Iref, and hence of each mirrored current Im, is dependent upon the stability of the supply voltage Vs.

Figure 2:
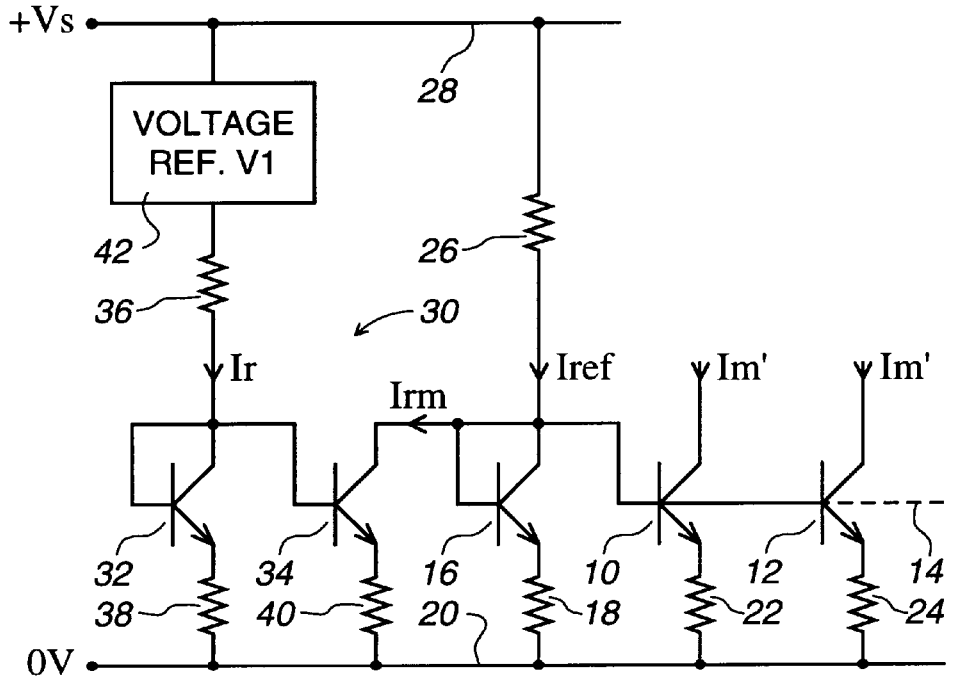
FIG. 2 illustrates a circuit diagram of a current mirror circuit in accordance with an embodiment of this invention.

FIG. 2 illustrates a circuit diagram of a current mirror circuit in accordance with an embodiment of this invention, the same references being used as in FIG. 1 to denote the same components as described above in relation to FIG. 1. The current mirror circuit of FIG. 2 differs from that of FIG. 1 in that it includes a further current mirror stage 30 described below, and consequently the mirrored currents conducted by the transistors 10 and 12 are different from those of FIG. 1 and are indicated as Im'.

The further current mirror stage 30 of the circuit of FIG. 2 comprises two bipolar NPN transistors 32 and 34, similar to the transistors 10, 12, and 16, arranged as a current mirror with their bases connected together, to the collector of the transistor 32, and to a resistor 36 which passes a reference current Ir, the emitters of the transistors 32 and 34 being coupled to the zero voltage line 20 via respective optional resistors 38 and 40. The emitter resistors 38 and 40 serve the same purposes of current sharing and thermal stability as the resistors 18, 22, and 24 as described above. The resistor 36 is coupled to the +Vs supply voltage line 28 via a voltage reference 42 which provides a reference voltage V1 as further described below.

The collector of the transistor 34, which conducts a current Irm which mirrors the reference current Ir conducted by the transistor 32, is connected to the interconnected base and collector of the transistor 16. Consequently, the collector current of the transistor 16 is reduced by Irm, and the transistors 10 and 12 each conduct the current Im' which mirrors the reduced current conducted by the transistor 16.

Again, known scaling techniques can be applied among the various transistors in the current mirror circuit of FIG. 2, but for simplicity are not described further here. Accordingly, in the current mirror circuit of FIG. 2 it can be seen that:

$$Irm=Ir=(Vs-V1-Vbe)/R$$

where Vbe is the base-emitter voltage of the transistor 32 and is assumed here to be substantially the same as the base-emitter voltage of the transistor 16 discussed above, and R is the total resistance of the resistors 36 and 38 and is assumed here to be the same as the total resistance of the resistors 18 and 26 discussed above. Accordingly:

$$Im'=Iref-Ir=\{(Vs-Vbe)/R\}-\{(Vs-V1-Vbe)/R\}=V1/R$$

so that each mirrored current depends on the reference voltage V1 and is independent of the supply voltage +Vs.

The voltage reference 42 can have any desired form. For example, it can comprise one or more of the following: voltage reference diodes, Zener diodes, Schottky diodes, junction diodes, diode-connected transistors, or potential differences provided by batteries or power supplies; it can be appreciated that any other desired form of voltage reference may alternatively be used.

Figure 3:
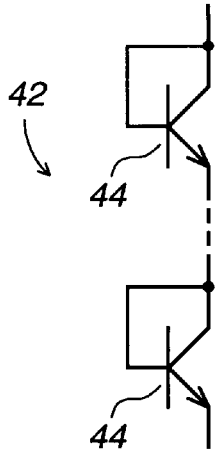
FIG. 3 illustrates one form of voltage reference circuit which may be used in the current mirror circuit of FIG. 2.

In a bipolar integrated circuit, it is particularly convenient for the voltage reference 42 to be constituted by a diode-connected transistor, or by a plurality of diode-connected transistors connected in series as shown in FIG. 3. As shown in FIG. 3, the voltage reference 42 is constituted by a desired number of N bipolar NPN transistors 44, two of which are shown, having their collector-emitter paths connected in series, with each transistor being diode-connected in that its base is connected to its collector, whereby the reference voltage V1 is equal to N times the base-emitter voltage of each transistor 44 at the current Ir.

It can be appreciated from the above description that in the current mirror circuit of FIG. 2 part of the current Iref is shunted via the transistor 34 so that it bypasses the transistor 16, and that this part Irm is exactly sufficient to remove the dependency on the supply voltage +Vs of the current passed by the transistor 16 and mirrored by the transistors 10 and 12. This is achieved when the total resistance of the resistors 36 and 38, i.e. in series with the controlled or collector-emitter path of the transistor 32, is equal to the total resistance of the resistors 18 and 26, i.e. in series with the controlled or collector-emitter path of the transistor 16.

Instead of the total resistances in series with these controlled paths being equal, i.e. having a ratio of 1 between them, they can be unequal, i.e. having a ratio greater than or less than 1 between them, to provide a controlled dependency of the current passed by the transistor 16, and hence of each mirrored current Im', on the supply voltage +Vs. For example, if the ratio of the total resistance of the resistors 36 and 38 in series with the controlled path of the transistor 32 to the total resistance of the resistors 18 and 26 in series with the controlled path of the transistor 16 is greater than 1, then the current passed by the transistor 16 and each mirrored current Im' will increase with increasing supply voltage +Vs, and if this ratio is less than one then the current passed by the transistor 16 and each mirrored current Im' will decrease with increasing supply voltage +Vs. Thus controlling the ratio of these total resistances enables dependency of each mirrored current Im' on the supply voltage to be controlled.

It can be appreciated that such control is only effective, and the above description and equations only apply, when the supply voltage +Vs and the voltage reference V1 are such that there is a flow of the current Ir, i.e. when Vs≧V1+Vbe (V1 can be constituted by a voltage supply, so that it can be positive or negative). For example, if V1>Vs, then the currents Ir and Irm will be zero and the further current mirror stage 30 of the current mirror circuit of FIG. 2 will have no effect. This situation can be used to advantage by providing a current mirror circuit with a plurality of further current mirror stages 30 as illustrated in FIG. 2, with respective voltage references and respective total resistance ratios, to provide any particular relationship which may be desired between the mirrored current produced by the current mirror circuit and the supply voltage. Each of such a plurality of further current mirror stages can bypass current from the transistor 16 as described above with respect to FIG. 2, thereby decreasing current conducted by the transistor 16, or in a similar manner it can be arranged to bypass current from another of the plurality of further current stages, thereby indirectly increasing current conducted by the transistor 16.

Figure 4:
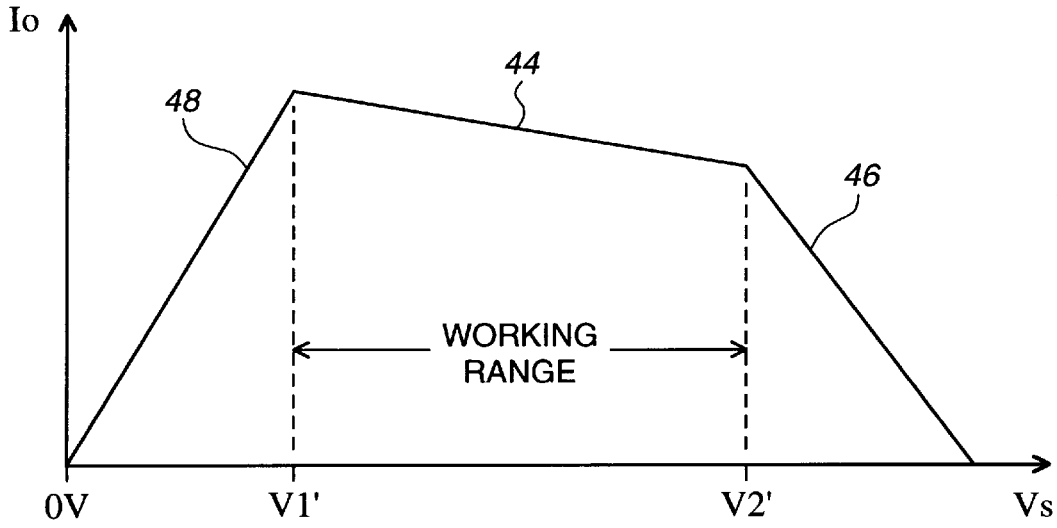
FIG. 4 is a graph showing variation of current with supply voltage.

By way of example of this, it may be desired to provide a current Io for use as a bias current for a transmitter power amplifier of a cellular radio telephone which varies in dependence upon a battery supply voltage Vs of the telephone in a manner as illustrated in FIG. 4. A normal working range for the telephone is with supply voltages in a range from a minimum supply voltage V1' to a maximum supply voltage V2'. Within this normal working range, for optimum operation (e.g. longest battery life consistent with a desired performance) it may be desired to increase the current Io as the supply voltage Vs falls (i.e. as the battery discharges), as shown by a line 44. Above this normal working range, it may be desired to decrease the current Io relatively rapidly with increasing supply voltage Vs, to provide a degree of over-voltage protection for excessive supply voltages above the maximum voltage V2', as shown by a line 46. Below the normal working range, the current Io is increased from zero at a supply voltage of zero up to a desired level at the minimum voltage V1', as shown by a line 48.

Figure 5:
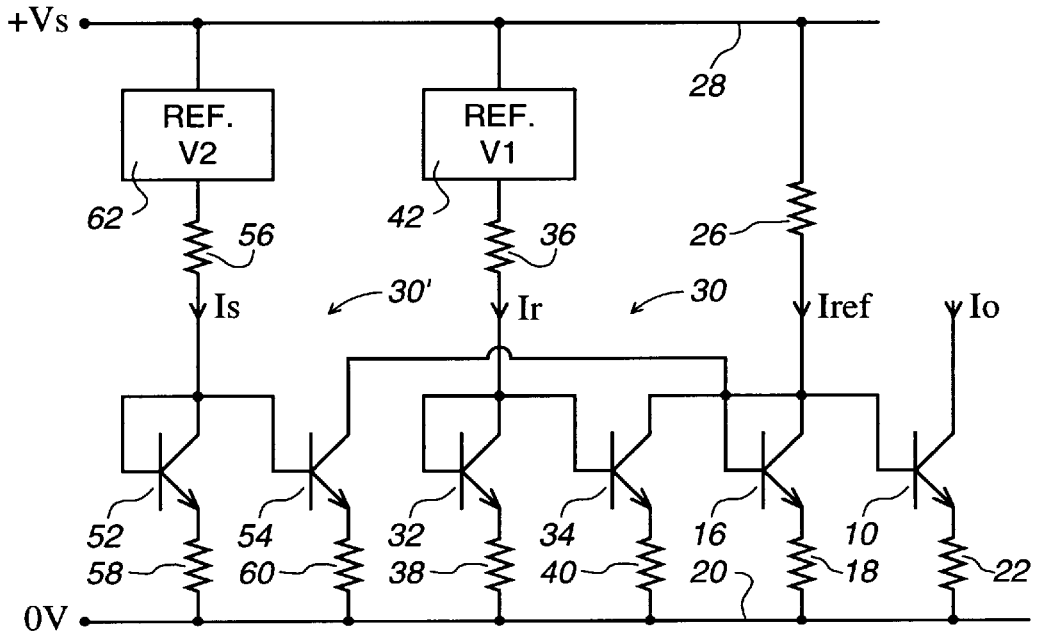
FIG. 5 illustrates a circuit diagram of a current mirror circuit in accordance with another embodiment of this invention for providing an output current based on the graph of FIG. 4.

FIG. 5 illustrates a current mirror circuit for providing a mirrored output current Io dependent upon a variable supply voltage +Vs based on the characteristic shown in the graph of FIG. 4. In FIG. 5 the same references as in FIG. 2 are used to denote the same components as described above. The current mirror circuit of FIG. 5 differs from that of FIG. 2 in that it includes an additional further current mirror stage 30', which is arranged in substantially the same manner as the further current mirror stage 30 as described above. This additional stage 30' comprises transistors 52 and 54, a resistor 56, optional emitter resistors 58 and 60, and a voltage reference 62, arranged in the same manner as the corresponding components 32 to 62 of the stage 30 as described above. The voltage reference 62 provides the reference voltage V2, and a current Is flows via the controlled path of the transistor 52 and is mirrored in the controlled path of the transistor 54. The reference voltages V1 and V2 provided by the voltage references 42 and 62 respectively are equal to the voltages V1' and V2' in the graph of FIG. 4 reduced by the base-emitter voltages of the transistors 32 and 52 for the currents Ir and Is respectively.

When the supply voltage +Vs is less than the voltage V1' (and hence also less than the voltage V2'), i.e. below the normal working range as shown in FIG. 4, the currents Ir and Is are zero so that the further current mirror stages 30 and 30' have no effect, and the output current Io which mirrors the reference current Iref increases in dependence upon the supply voltage +Vs in accordance with the line 48 in FIG. 4.

When the supply voltage +Vs is greater than the voltage V1' and less than the voltage V2', i.e. within the normal working range as shown in FIG. 4, the current Is is zero, and the current Ir is mirrored and subtracted from the current Iref so that a reduced current flows via the controlled path of the transistor 16 and is mirrored as the output current Io. The total resistance of the resistors 36 and 38 is chosen to be less than the total resistance of the resistors 18 and 26, i.e. the resistance ratio as discussed above is less than one, so that in this normal working range the mirrored output current Io decreases with increasing supply voltage +Vs, in accordance with the line 44 in FIG. 4, the resistance ratio being selected in accordance with the desired gradient of the line 44.

When the supply voltage +Vs is greater than the voltage V2' (and hence also greater than the voltage V1'), i.e. above the normal working range as shown in FIG. 4, the current Is is also no longer zero, both non-zero currents Ir and Is being mirrored and subtracted from the current Iref so that a further reduced current flows via the controlled path of the transistor 16 and is mirrored as the output current Io. The total resistance of the resistors 56 and 58 is chosen to be less than the total resistance of the resistors 18 and 26, i.e. this resistance ratio is also less than one, so that the mirrored output current Io decreases more rapidly with increasing supply voltage +Vs, in accordance with the line 46 in FIG. 4, this resistance ratio being selected in accordance with the desired increased gradient of the line 46 in comparison to the gradient of the line 44.

It can be appreciated that, in the current mirror circuits of FIGS. 2 and 5, the output currents Im' and Io are mirrored from a difference current of, for example, Iref−Irm. In order to keep the currents, e.g. Iref and Ir, contributing to this difference current relatively small for efficiency and low power dissipation, generally the output current mirror transistors, e.g. the transistor 10, will desirably be scaled relative to the transistor 16 using scaling techniques which are known in the art. Such scaling techniques can also be applied within the remainder of the current mirror circuit.

It can be appreciated that numerous other techniques known in the art of current mirror circuits and current sources can also be applied to the current mirror circuits described above while still providing the advantages of this invention. For example, the current mirror circuits described above may be modified to use more complicated transistor arrangements, e.g. using high fan-out or gain-compensated transistors, to use different polarities or types of transistors including field effect transistors, to incorporate electronic control for example by switching to facilitate providing further functions such as analog or digital current control for warm standby or power control of circuits, to use more further current mirror stages in different combinations to provide desired output current versus supply voltage characteristics, and so on.

Thus although particular embodiments of the invention have been described in detail by way of example, it should be appreciated that the alternatives specifically mentioned above and numerous other modifications, variations, and adaptations may be made without departing from the scope of the invention as defined in the claims.

What is claimed is:

1. A current mirror circuit comprising:

a first current mirror comprising a first transistor having a control electrode and a controlled path, a first resistor coupled between the controlled path of the first transistor and a supply voltage for determining a first reference current, and a second transistor having a control electrode coupled to the control electrode of the first transistor and having a controlled path for conducting an output current which mirrors current conducted via the controlled path of the first transistor; and a second current mirror comprising a third transistor having a control electrode and a controlled path, a second resistor and a voltage reference coupled in series between the controlled path of the third transistor and the supply voltage for determining a second reference current, and a fourth transistor having a control electrode coupled to the control electrode of the third transistor and having a controlled path for conducting a current which mirrors current conducted via the controlled path of the third transistor;

wherein the controlled paths of the first and fourth transistors are coupled together so that the controlled path of the first transistor conducts the first reference current reduced by the current conducted via the controlled path of the fourth transistor.

2. A current mirror circuit as claimed in claim 1 wherein the current mirrors are arranged so that the output current is dependent upon the voltage reference and is substantially independent of the supply voltage.

3. A current mirror circuit as claimed in claim 1 wherein the current mirrors are arranged so that the output current decreases with increasing magnitude of the supply voltage greater than a reference voltage provided by the voltage reference.

4. A current mirror circuit as claimed in claim 1 and further comprising:

a third current mirror comprising a fifth transistor having a control electrode and a controlled path, a third resistor and a second voltage reference coupled in series between the controlled path of the fifth transistor and the supply voltage for determining a third reference current, and a sixth transistor having a control electrode coupled to the control electrode of the fifth transistor and having a controlled path for conducting a current which mirrors current conducted via the controlled path of the fifth transistor;

wherein the controlled path of the sixth transistor is coupled to the controlled path of the first transistor so that current conducted via the controlled path of the first transistor is further reduced by the current conducted via the controlled path of the sixth transistor.

5. A current mirror circuit as claimed in claim 1 wherein each transistor comprises a bipolar transistor having a base constituting the control electrode and a collector-emitter path constituting the controlled path of the transistor.

6. A current mirror circuit as claimed in claim 5 and including an emitter resistor coupled in series with the collector-emitter path of each transistor.

7. A current mirror circuit as claimed in claim 5 wherein the voltage reference comprises at least one diode-connected bipolar transistor.

8. A method of producing a controlled current, comprising the steps of:

producing a first reference current dependent upon a supply voltage;

producing a second reference current dependent upon a difference between the supply voltage and a first reference voltage;

mirroring the second reference current to produce a mirrored current;

producing a difference current dependent upon a difference between the first reference current and the mirrored current; and mirroring the difference current to produce the controlled current.

9. A method as claimed in claim 8 wherein the first and second reference currents are produced with similar dependence upon the supply voltage so that the difference current is substantially independent of the supply voltage for values of the supply voltage greater than the first reference voltage.

10. A method as claimed in claim 8 wherein the first and second reference currents are produced so that the difference current decreases with increasing values of the supply voltage greater than the first reference voltage.

11. A method as claimed in claim 10 and further comprising the steps of:

producing a third reference current dependent upon a difference between the supply voltage and a second reference voltage, the second reference voltage being greater than the first reference voltage;

mirroring the third reference current to produce a second mirrored current; and reducing the difference current by the second mirrored current.

12. A method as claimed in claim 8 and further comprising the steps of:

producing a third reference current dependent upon a difference between the supply voltage and a second reference voltage, the second reference voltage being greater than the first reference voltage;

mirroring the third reference current to produce a second mirrored current; and reducing the difference current by the second mirrored current.

13. A current mirror circuit comprising:

a first resistor for conducting a first reference current dependent upon a supply voltage;

a first current mirror coupled to the first resistor;

a second resistor for conducting a second reference current dependent upon the supply voltage and a reference voltage; and a second current mirror coupled to the second resistor and being arranged to mirror the second reference current to produce a mirrored current at an output of the second current mirror, said output being coupled to the first current mirror;

the first current mirror being arranged to mirror a difference current between the first reference current and said mirrored current to produce a controlled current.

14. A current mirror circuit as claimed in claim 13 wherein the resistors and the current mirrors are arranged so that the controlled current is substantially independent of the supply voltage for values of the supply voltage greater than the reference voltage.

15. A current mirror circuit as claimed in claim 13 wherein the resistors and the current mirrors are arranged so that the controlled current decreases with increasing values of the supply voltage greater than the reference voltage.

16. A current mirror circuit as claimed in claim 13 wherein each of the current mirrors comprises two bipolar transistors, each transistor having a collector-emitter path coupled in series with an emitter resistor.

17. A current mirror circuit as claimed in claim 16 wherein the first resistor is coupled to a line for the supply voltage, and the second resistor is coupled in series with at least one diode-connected bipolar transistor, providing said reference voltage, to the line for the supply voltage.

18. A current mirror circuit as claimed in claim 13 and further comprising:

a third resistor for conducting a third reference current dependent upon the supply voltage and a second reference voltage; and a third current mirror coupled to the third resistor and being arranged to mirror the third reference current to produce a second mirrored current at an output of the third current mirror, said output being coupled to one of the first and second current mirrors to modify current mirrored thereby.

* * * * *